US006899635B2

(12) United States Patent
Nadratowski et al.

(10) Patent No.: US 6,899,635 B2
(45) Date of Patent: May 31, 2005

(54) DEVICE FOR USE WITH A GOLF CLUB TO PICK UP OBJECTS

(76) Inventors: Robert Nadratowski, R.R. 2 Box 329, Hawley, PA (US) 18428; John Arthur Nadratowski, 297 Schwabbie Turnpike, Kerhonkson, NY (US) 12446

( * ) Notice: Subject to any disclaimer, the term of this patent is extended or adjusted under 35 U.S.C. 154(b) by 0 days.

(21) Appl. No.: 10/713,704

(22) Filed: Nov. 17, 2003

(65) Prior Publication Data

US 2004/0166955 A1 Aug. 26, 2004

Related U.S. Application Data

(60) Provisional application No. 60/450,092, filed on Feb. 26, 2003.

(51) Int. Cl.[7] ..... A63B 53/00; A63B 47/02

(52) U.S. Cl. ..... 473/285; 473/286; 294/19.2

(58) Field of Search ..... 473/406, 282–286; 294/19.2

(56) References Cited

U.S. PATENT DOCUMENTS 5,690,558 A * 11/1997 Huber ..... 473/285
6,585,606 B2 * 7/2003 Penrose ..... 473/284

* cited by examiner

*Primary Examiner*—Stephen Blau

(57) ABSTRACT

A device utilizing a soft rubber composition disk and a soft composition suction cup with a magnetic ball marker located on the end of a golf club grip. To pick up golf balls on the course (including shallow water hazards), most specifically, to pick up golf balls from the holes and ball markers used in the game without bending over.

5 Claims, 4 Drawing Sheets

DEVICE FOR USE WITH A GOLF CLUB TO PICK UP OBJECTS

This application claims benefit of 60/450,092 dated Feb. 26, 2003.

BACKGROUND OF THE INVENTION

1. Field of the Invention

This invention relates to the game of golf and more specifically relates to a device that is readily affixed to the handle end of a golf club, most usually a putter, to be used to recover wet or dry golf balls as well as other objects without bending over and, of greatest importance, to recover golf balls from the holes used in the game of golf, where the ball is lower than the surface on which the player is standing.

2. Prior Art and Objects

The game of golf is extremely popular. Many people play the game and it is most popular with older and retired people. Frequently, many of these people have problems with bending over and that problem is aggravated when there is a need to pick up a golf ball which is below the surface on which the player is standing. In the game of golf, as well known, a player strives to place the ball within a hole which is several inches deep. Then it becomes necessary to remove the ball which requires bending over to the extent that the hand of the player must reach several inches below the surface of the ground.

No device is known in the game of golf which permits players to recover a ball from a hole without bending over and which does not require any substantial equipment other than what is already needed to play the game of golf.

Also, in playing golf, a marker is used to spot the last location of the golf ball before being played into the hole. A marker is used which is a colored disc on a pin. The markers are small and easy to misplace.

Accordingly, it is an object of this invention to provide a device which may be conveniently affixed to the end of the grip of a golf club, most likely a putter and which permits the golf club to be used in an inverted position to pick up a ball from a hole without any bending being required.

It is a further object of this invention to provide a readily assessable place to store a marker to spot the location of a golf ball when removal of the ball from the playing field is needed.

It is still another object of this invention to provide a device for picking up a golf ball which is both inexpensive and durable.

It is another object of this invention to provide a device which can be conveniently carried while on a golf course.

It is another object of this invention to provide a device which can be easily secured on the end of the handle of the golf club without interfering with the use of the golf club.

These and other objects of the invention will become apparent from the following description in connection with the appended drawings illustrating preferred embodiments of the invention. It is to be understood, however, that these are given by way of illustration and not of limitation and that changes may be made in the detailed construction, form and size of the parts, without affecting the scope of the invention.

SUMMARY OF INVENTION

In this embodiment, a vinyl tapered cup or cone with a center hole is placed in line with the hole in the grip handle. Placed into the vinyl cup is a round tapered nylon disk with a hollow stem and cone. The cone locks the device in place on the putter grip. Placed in the disk is a split pin and soft silicone suction cup which has a centered recess to receive a magnet. Placed on top of the magnet and suction cup is a seven eighths inch soft silicone disk. A barbed tack is driven into the split pin to hold the unit together. The purpose of the tapered cup is to capture the ball and direct it into the soft rubber pick up surface.

Markers are used in the game of golf to locate the balls position on the green. They are easily lost and hard to retrieve from the trouser pocket. Such markers are generally disks with a pin located in the center. The marker in this embodiment is one inch in diameter and has a magnet in the center. This magnet is drawn to the magnet in the disk and holds the marker in place for easy access to the golfer.

DETAILED DESCRIPTION OF THE INVENTION

Figure 1:
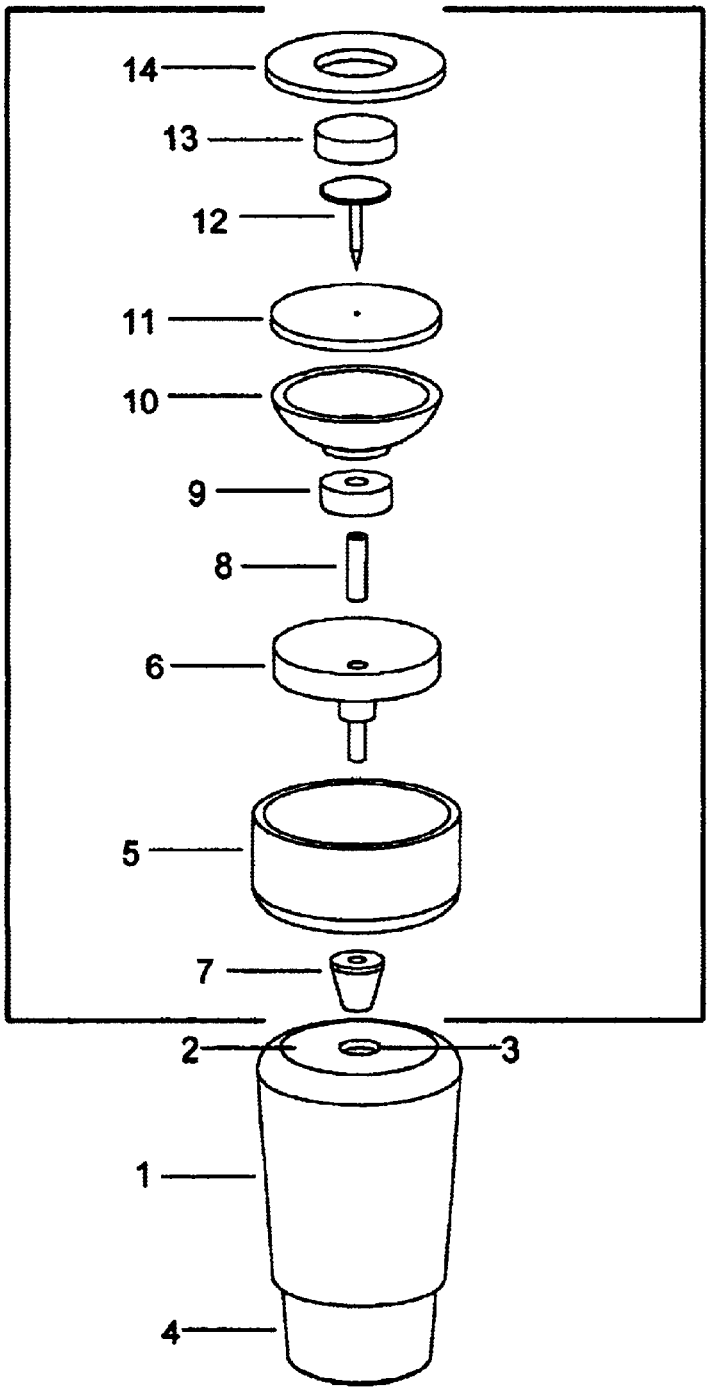
FIG. 1 is an exploded view showing the separate parts of the device (Numbers 5, 6, 7, 8, 9, 10, 11, 12, 13, 14, and 15.) Numbers 1, 2, 3, and 4 are not a part of this device.
Figure 2:
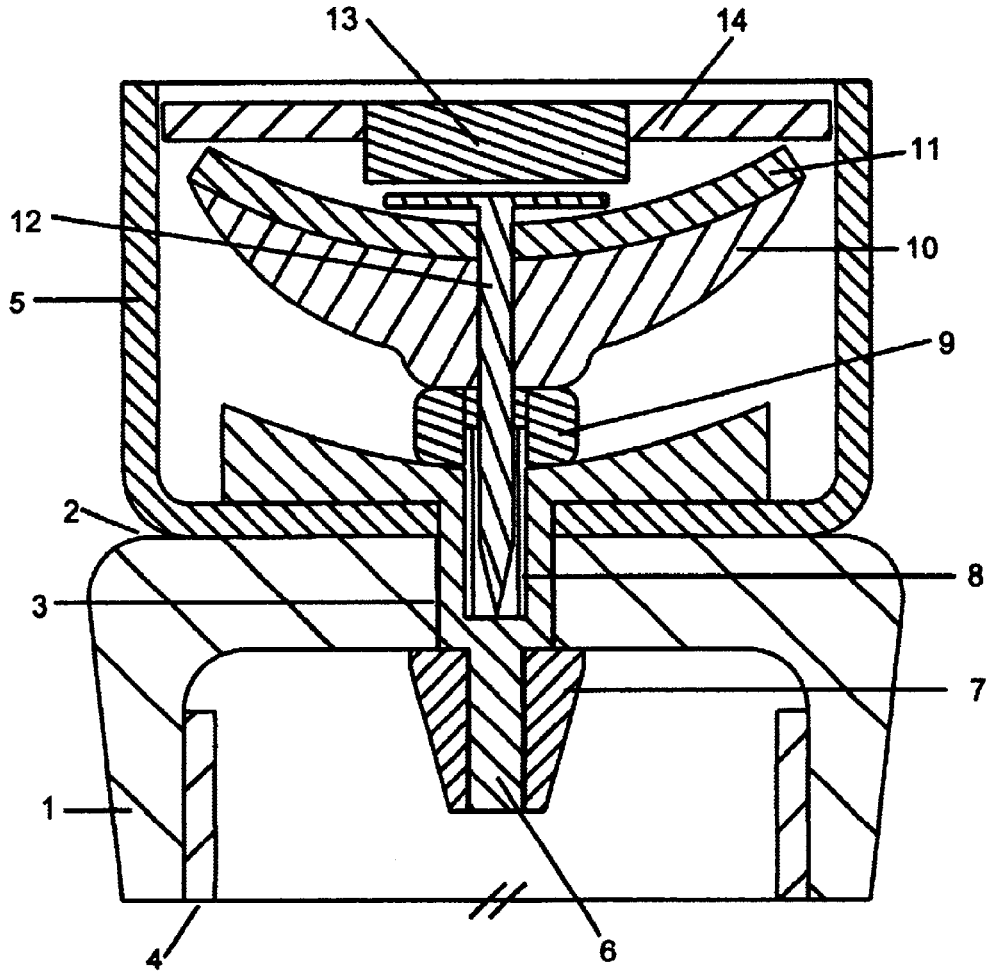
FIG. 2 is a side elevation of the device showing the device inserted into a golf grip and locked in place by the cone.
Figure 3:
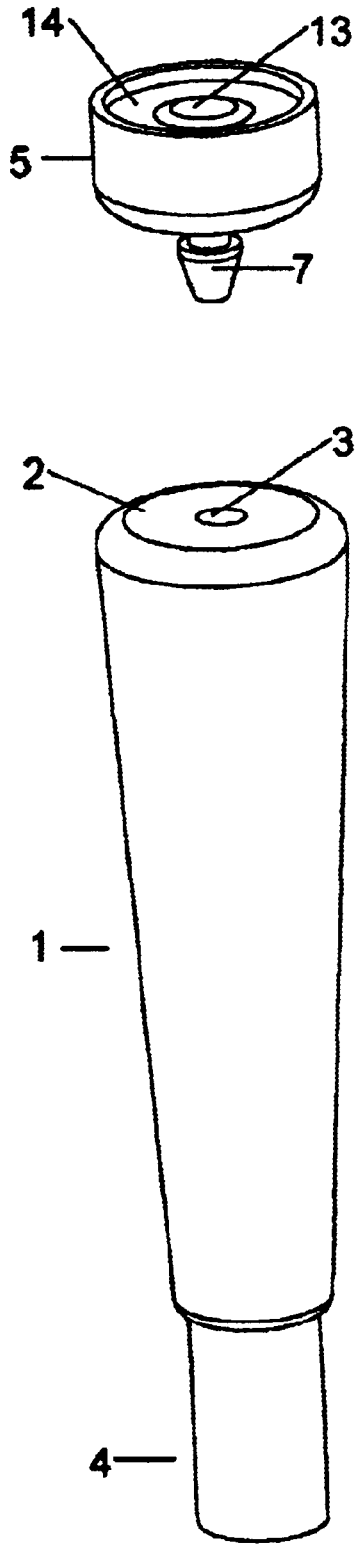
FIG. 3 shows the device in line with the grip hole ready for insertion into the grip.
Figure 4:
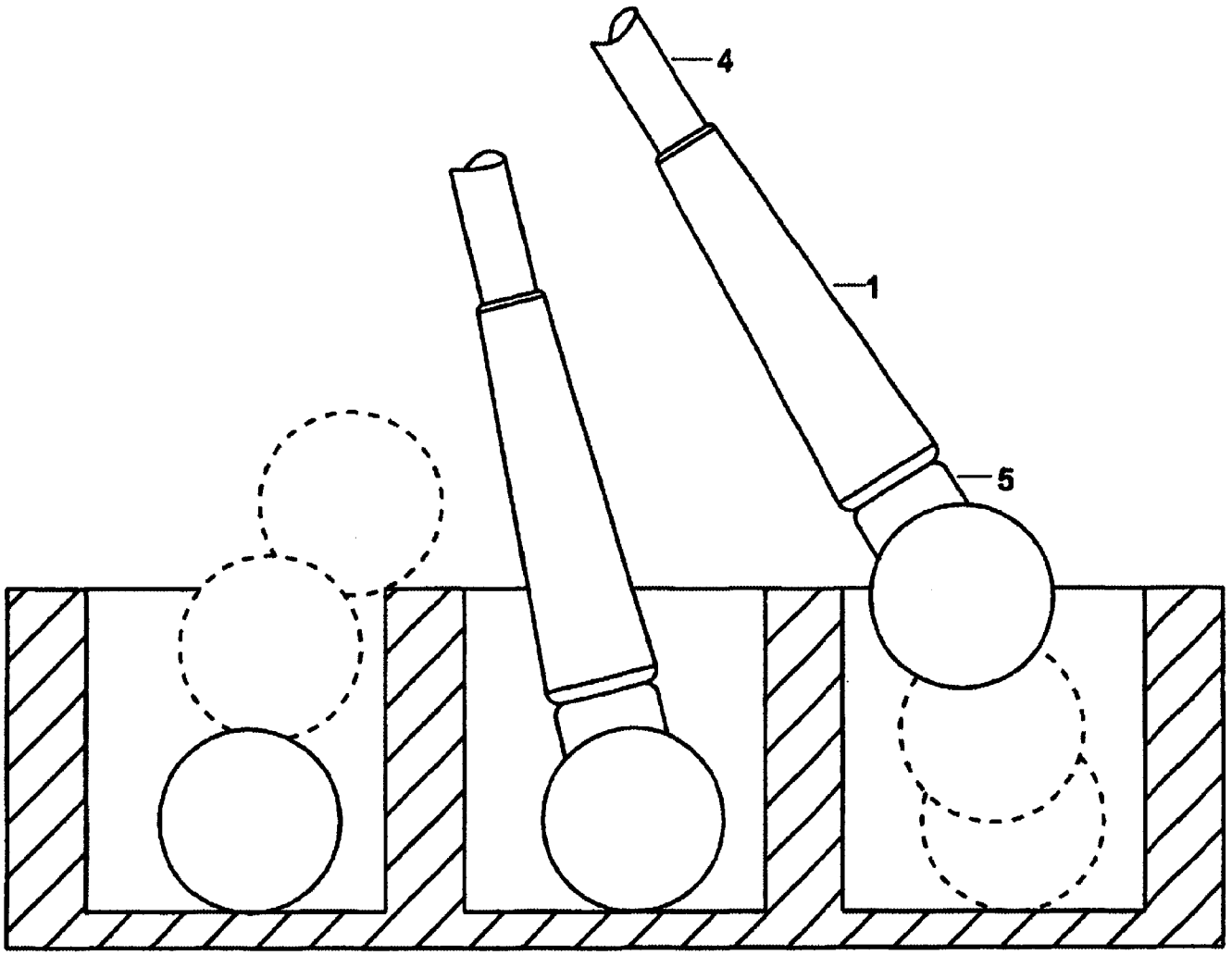
FIG. 4 shows the device retrieving the golf ball from the hole on the golf course.

As best seen in FIG. 1, a golf club grip 1 is shown. The golf club grip 1 is mounted on the golf club handle 4. At the outside end 2 of the grip 1 is a vent hole 3 which is universally provided in the grip 1 to permit ventilation into the handle 4 and allows venting to occur when installing a new golf grip 1.

FIG. 1 in this embodiment the end of a grip 2 is shown with the opening 3 in it at the outside end which is a consistent feature for golf clubs regardless of manufacturer. A vinyl cup 5 which has a one eighth inch center hole is placed about the opening 3. Inserted through the vinyl cup 5 is a retainer 6 which has a stem. Glued to the tip of the retainer stem 6 is a cone 7 which is pushed through the grip vent hole 3 to secure the unit to the grip 1. Inserted in the retainer 6 is a split pin 8. A magnet 9 with a center hole is placed onto the split pin 8 and does not protrude above the magnet 9. A soft silicone, neoprene or other soft rubber compositions of twenty to forty duro suction cup 10 is placed around and over the magnet 9.

A soft disk 11 twenty to forty duro silicone, neoprene other compositions is placed on the suction cup 10. The soft disk 11 fills the voids in the golf ball which creates a suction on the voids and maintains a smooth outer surface which enables the suction cup 10 to create a vacuum and pick up the golf balls wet or dry.

A tack that has a flat head with a barbed shaft 12 is driven through the soft disk 11, the suction cup 10, the center hold in the magnet 9 and into the split pin 8 which secures the pick up units 11, 10, and magnet 9 to the retainer 6.

The magnet 13 is affixed to the ball marker 14 which holds the marker in place at the top of the grip 1 for ready use.

What is claimed is:

1. A device for picking up items to be used with a golf club having a handle with a mallet at one end and a hand grip having an outside end remote from the mallet and having a generally center opening at the outside end (vent hole), the device comprising:

a vinyl cup with a hole in the center;

a nylon retainer and nylon cone are inserted through the vinyl cup into the hole in the grip to lock the vinyl cup and retainer in place on the grip;

a split pin is inserted into the center of the retainer;

a magnet with a center hole is driven over the split pin;

a soft silicone suction cup with a center hole is placed over the magnet;

a soft silicone disk is centered in the suction cup;

a flat head tack which has a barbed shaft is driven through the disk, suction cup, magnet and into the split pin to secure the unit to the retainer.

2. A device for picking up items to be used with a golf club according to claim 1 that is able to lock onto a vented grip and is easily removed and installed on the vented grip.

3. A device for picking up items to be used with a golf club according to claim 1 that is able to pick up a wet or dry golf ball in or out of water.

4. A device for picking up items to be used with a golf club according to claim 1 that is small enough to remain a permanent piece of equipment on a golf club without obstructing the view of a golfer when using a golf club.

5. A device for picking up items to be used with a golf club according to claim 1 that has a magnetic ball marker built in the device which is near a golfer's fingertips on a grip wherein the device is able to pick up a marker from a course.

* * * * *